United States Patent [19]

Almen

[11] 4,234,039

[45] Nov. 18, 1980

[54] RADIATOR

[75] Inventor: Rune Almén, Halmstad, Sweden

[73] Assignee: Sensotherm AB, Sweden

[21] Appl. No.: 892,436

[22] Filed: Mar. 31, 1978

[30] Foreign Application Priority Data

Apr. 1, 1977 [SE] Sweden ..... 7703837

[51] Int. Cl.[3] ..... F28F 9/00

[52] U.S. Cl. ..... 165/67; 312/100; 165/78

[58] Field of Search ..... 165/55, 67, 69, 82, 165/78; 312/100, 204; 220/331, 100

[56] References Cited

U.S. PATENT DOCUMENTS

| | | | |
|---|---|---|---|
| 1,888,900 | 11/1932 | Austen | 165/67 X |
| 2,696,368 | 12/1954 | Edwards | 165/67 X |
| 3,342,537 | 9/1967 | Nelson et al. | 312/100 |
| 3,448,795 | 6/1969 | McNabney | 165/67 |
| 4,067,627 | 1/1978 | Hodge | 312/100 |

FOREIGN PATENT DOCUMENTS

| | | | |
|---|---|---|---|
| 585068 | 11/1958 | Italy | 220/331 |

*Primary Examiner*—Samuel Scott
*Assistant Examiner*—Theophil W. Streule, Jr.
*Attorney, Agent, or Firm*—Karl W. Flocks

[57] ABSTRACT

A radiator for mounting on a wall comprises a heating element and a front panel covering the heating element and fitted on the front side thereof. The front panel is displaceable relative to the heating element in that the opposed horizontal sides of said front panel are bent over in U- or V-shape for engagement with corresponding projections of the heating element. At least those projections of the heating element which engage one of the bent-over, U- or V-shaped sides of the front panel consist of spring-biased bodies.

3 Claims, 7 Drawing Figures

RADIATOR

The present invention relates to a radiator for mounting on a wall or like support, comprising a heating element and a front panel covering the heating element and fitted on the front side thereof, the opposed horizontal sides of said front panel being bent over in U- or V-shape to engage corresponding projections of the heating element so that the front panel will be displaceable relative to the heating element. Characteristic of the invention is that at least those projections of the heating element which engage one of the bent-over, U- or V-shaped sides of the front panel consist of spring-biased bodies. The invention highly simplifies mounting of the front panel to the heating element and it also facilitates carrying out adjustments and repairs since it will be easy to displace or remove the front panel so that the mounting connections normally provided in one end wall of the heating element for connecting said element to a heating system will be readily accessible. The spring-biased bodies further involve an essential advantage in that the front panel will become thoroughly fixed to the heating element so that the front panel cannot rattle in case of vibrations.

The invention will be described in greater detail hereinafter with reference to the accompanying drawings which illustrate a preferred embodiment of the radiator and in which.

Figure 1:
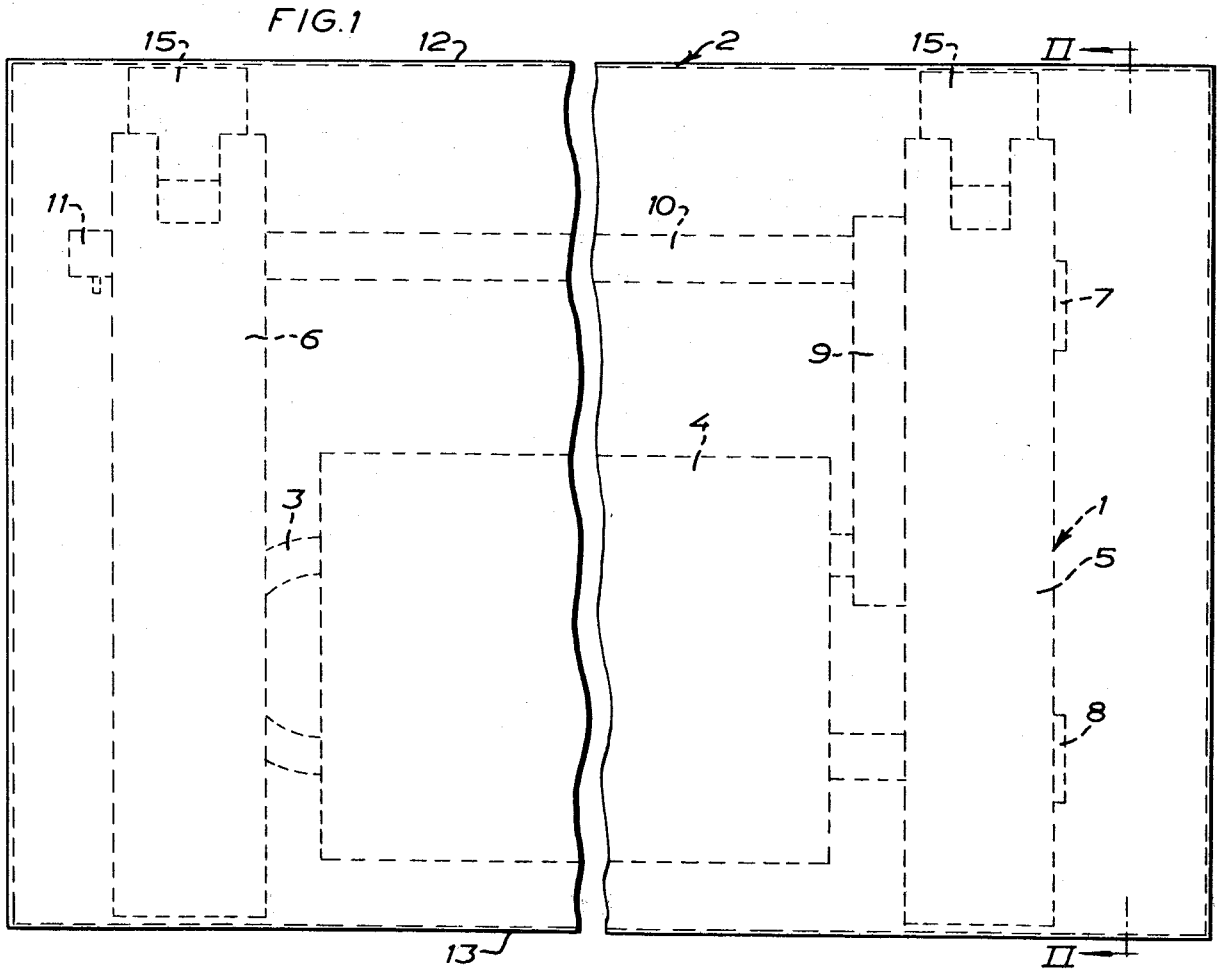
FIG. 1 is a front view of the radiator.

The radiator consists of the heating element 1 and the front panel 2 arranged on the front side of the heating element 1.

The heating element 1 includes a coil of tubing 3 and convector plates 4 arranged thereon. The coil of tubing 3 is mounted at tubular frames 5 and 6 which constitute the end walls of the heating element 1. The frame or end wall 5 is provided with mounting connections 7 and 8 for connecting the heating element 1 to a heating system which will normally consist of the pipelines of a closed hot-water system. Also provided on the frame 5 is an air vessel 9 from which a deaerating pipe 10 extends to the frame 6, said pipe having a deaerating screw 11 on the outside of the frame 6.

The front plate 2 is substantially longer than the heating element 1 so that it will thoroughly cover the connections 7 and 8 and the pipelines connected thereto. However, the front panel 2 is adapted to be displaceable on the front side of the heating element 1 in such a way that the mounting connections 7 and 8 are uncovered or at least freely accessible when the front panel 2 is in its laterally displaced position, and therefore all mounting work can in most cases be carried out without it being necessary to remove the front panel 2.

Figure 2:
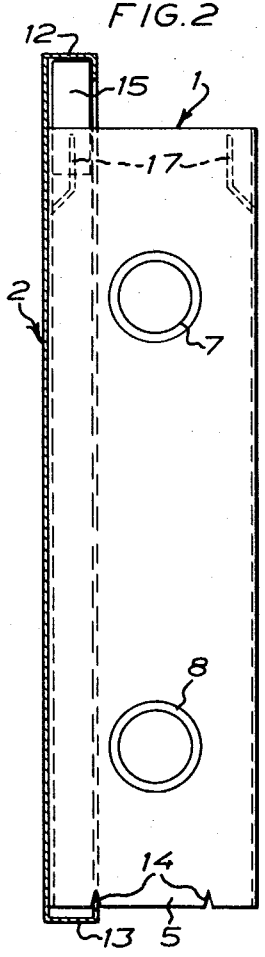
FIG. 2 is a sectional view on line II—II of FIG. 1.

The horizontal sides 12 and 13 of the front panel 2 are at least in principle bent over in U-form, whereby these U-shaped sides 12 and 13 or upper and lower horizontal edges, respectively, bent inwardly behind front panel 2 will serve as guides for the displacement of the front panel 2. Thus the free leg of the side 13 engages grooves 14 in the frames 5 and 6 while a spring-biased body 15 at the top side of the frames 5 and 6 engages the groove in the side 12. As may be readily seen in FIG. 2 upper edge 12 includes a downwardly directed portion and lower edge 13 includes an upwardly directed portion. The downwardly directed portion of upper edge 12 encloses abutment members 15 supported on transversely offset tongue-like projections 17. Alternatively, it would be possible to make the sides 12 and 13 generally V-shaped.

When the front panel 2 is to be mounted on the heating element 1 it is applied on the bodies 15 with its groove at the side 12, whereupon said panel is pressed down against the action of the springs 16 of the bodies 15 so that the free leg, or upwardly directed portion at the side 13 can be swung inwardly under the frames 5 and 6 and engage the grooves 14 therein. Dismantling is operated in a corresponding manner, i.e. the leg at the side 13 is swung from the frames 5 and 6 when the front panel 2 is pressed down against the action of the springs 16.

Figure 3:
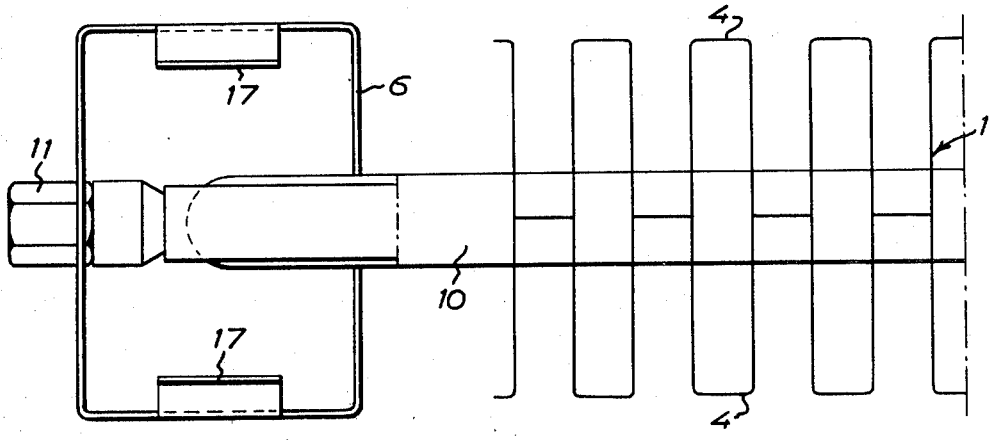
FIG. 3 is a top plan view of part of the heating element.
Figure 4:
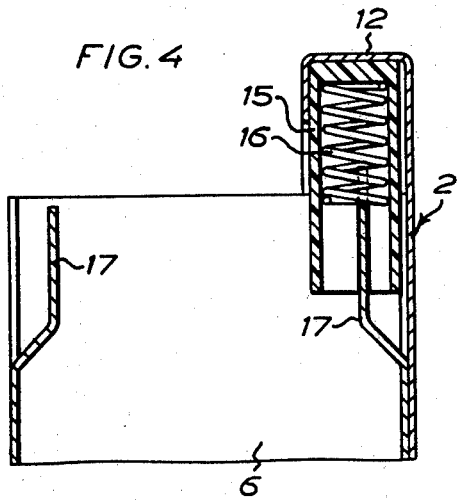
FIG. 4 is a cross-sectional view of a spring-biased body engaged by the front panel.
Figure 5:
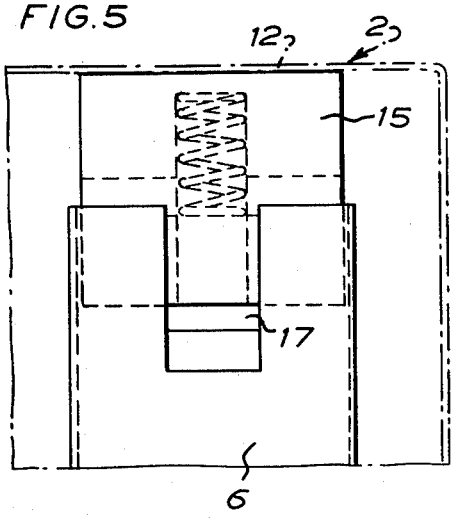
FIG. 5 is a side view of said body likewise engaged by the front panel.
Figure 6:
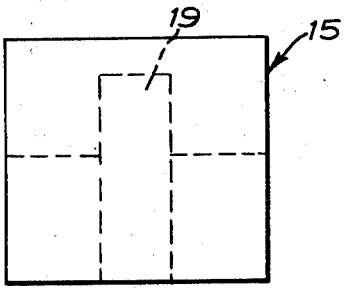
FIGS. 6 and 7 show the body proper as viewed in two directions which are perpendicular to one another.
Figure 7:
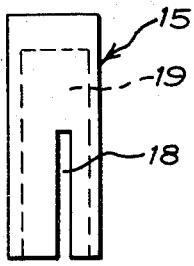

As is best seen in FIG. 3 the central plane through the rectangular frames 5 and 6 constitutes a symmetry plane for the heating element 1 so that the bodies 15, preferably consisting of plastics material, which are biased by the springs 16, and thus the front panel 2, can be mounted on one or the other side of the heating element 1. To permit mounting of the bodies 15, the frames 5 and 6 are provided transversely offset portions or punched-out tongues 17 which, together with the adjacent inner sides of the frames 5 and 6, form guides for the bodies 15. The tongues 17 engage slits 18 in the bodies 15. The bodies 15 which operate as abutment members, are also provided with bottom holes 19 for the springs 16 which are adapted to abut against the upper edge of the tongues 17.

The frames 5 and 6 are provided with grooves 14 opposite each tongue 17.

In the embodiment shown all the sides of the front panel 2 are bent over in U-shape, which provides stability for the front panel 2 at the same time as the vertical sides constitute natural stops for lateral displacement of the front panel 2.

The radiator is designed for mounting on brackets on a wall, said brackets being adapted to engage recesses in the frames 5 and 6.

The invention is not restricted to that which is described above and shown in the drawings but may be varied within the scope of the appended claims.

What I claim and desire to secure by Letters Patent is:

1. Radiator construction for mounting on a wall or like support comprising in combination a heating element and a front panel having an upper horizontal edge and a lower horizontal edge fitted on the front of said heating element and covering same thereat, said heating element having a plurality of projections adapted to be engaged by said front panel, said edges being bent inwardly behind said front panel with a downwardly directed portion extending from said upper horizontal edge and an upwardly directed portion extending from said lower horizontal edge in engagement with corresponding ones of said projections in assembled condition of said panel on said heating element, said front panel being substantially longer than said heating element so that said front panel may fully cover said heating element and also may be displaced laterally with respect thereto without being removed therefrom, wherein at least some of said projections are in the form of transversely offset tongue portions each having an abutment member disposed over a free end and spring means between each of said abutment member and the offset tongue portion associated therewith to thereby urge said abutment member against one of said upper and lower horizontal edges and others of said projections of said heating element are in the form of vertical grooves holding the portion extending from the other of said upper and lower horizontal edges with said spring means while urging said abutment members against said one of said upper and lower horizontal edges are also effective in urging the other of said upper and lower horizontal edges to remain held in said projections which are in the form of grooves.

2. Radiator as claimed in claim 1, wherein the heating element is provided with suitable rectangular, tubular frames at its end walls, the central plane through the frames constituting a symmetry plane for the heating element so that the spring-biased abutment members, which are adapted to coact with the frames, and thus the front panel, can be mounted on one or the other side of the heating element.

3. Radiator as claimed in claims 1 or 2, wherein the vertical grooves in the heating element are arranged at those end portions of the tubular frames which are remoted from the spring-biased abutment members.

* * * * *